US006768888B1

(12) United States Patent
Zhang et al.

(10) Patent No.: US 6,768,888 B1
(45) Date of Patent: Jul. 27, 2004

(54) METHOD AND APPARATUS FOR ATTENUATING EFFECTS OF POSITIVE OVER-SPRAY ON PHOTORECEPTOR

(75) Inventors: Shengliang Zhang, Rochester, NY (US); Brian J. Larocque, Rochester, NY (US); Jeffrey W. Drawe, Bloomfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/248,385

(22) Filed: Jan. 15, 2003

(51) Int. Cl.[7] ..... G03G 21/00; G03G 21/06; G03G 21/08

(52) U.S. Cl. ..... 399/128

(58) Field of Search ..... 399/9, 31, 32, 399/50, 51, 127, 128, 130, 159

(56) References Cited

U.S. PATENT DOCUMENTS 4,538,901 A * 9/1985 Soumiya ..... 399/128
4,757,345 A * 7/1988 Ohashi et al. ..... 399/128
4,827,306 A * 5/1989 Tsujimoto et al. ..... 399/128
5,729,800 A * 3/1998 Ohba et al. ..... 399/159
6,070,032 A * 5/2000 Rokutanda et al. ..... 399/128
6,132,911 A * 10/2000 Niimi ..... 399/159 X
6,208,819 B1 * 3/2001 Pai et al. ..... 399/128
6,223,011 B1 * 4/2001 Abramsohn et al. ..... 399/128
6,246,850 B1 * 6/2001 Buttles et al. ..... 399/128
6,456,805 B2 * 9/2002 Buttles et al. ..... 399/128
6,521,387 B2 * 2/2003 Kawasaki ..... 399/159 X

FOREIGN PATENT DOCUMENTS

JP 57-029075 * 2/1982
JP 58-182681 * 10/1983

* cited by examiner

*Primary Examiner*—Sandra L. Brase
(74) *Attorney, Agent, or Firm*—Oliff & Berridge, PLC

(57) ABSTRACT

Image quality of an image generated by a xerographic or equivalent image generating process may develop non-uniform charge characteristics, in addition to other negative effects, as a result of positive over-spray, but these negative effects can be at least attenuated by exposure of the photoreceptor to fluorescent light.

36 Claims, 7 Drawing Sheets

METHOD AND APPARATUS FOR ATTENUATING EFFECTS OF POSITIVE OVER-SPRAY ON PHOTORECEPTOR

BACKGROUND OF THE INVENTION

1. Field of Invention

This invention relates to exposing a photoreceptor to fluorescent light in order to attenuate the effects of positive over-spray on the photoreceptor.

2. Description of Related Art

In xerography, or electrophotographic printing/copying, a charge-retentive device called a photoreceptor is electrostatically charged, and then exposed to a light pattern of an input image to selectively discharge the surface in accordance with the image. The resulting pattern of charged and discharged areas on the photoreceptor forms an electrostatic charge pattern, i.e., a latent image, conforming to the input image. The latent image is developed by contacting it with finely divided electrostatically attractable powder called toner. Toner is held on the image areas by the electrostatic force. The toner image may then be transferred to a substrate or support member, and the image is then affixed to the substrate or support member by a fusing process to form a permanent image thereon. After transfer, excess toner left on the photoreceptor is cleaned from its surface and residual charge is erased from the photoreceptor.

In systems where both the photoreceptor and the toner are negatively charged, the latent image is also negatively charged. During transfer, the substrate or support member is brought into contact with the photoreceptor, covering the toner image, and is sprayed with positive ions. This enables the negatively charged toner image to transfer from the photoreceptor to the substrate or support member. For optimal image production, the photoreceptor should be uniformly charged across its entire surface.

SUMMARY OF THE INVENTION

Multilayered organic photoreceptors are generally designed to work in negative charging mode. During transfer, locations on the photoreceptor surface that are not covered by the substrate or support member are exposed to the spray of positive ions. This phenomenon will herein be referred to as "positive over-spray." The present inventors have discovered that positive over-spray has a negative impact on the performance of multilayered organic photoreceptors. Specifically, transfer corotron positive over-spray results in localized high dark decay on the photoreceptor and consequently voltage non-uniformity.

In subsequent cycles of the xerographic process, the portion of the photoreceptor surface that received the positive charge due to positive over-spray will have a different exposure potential than the portion of the photoreceptor surface that was covered by the substrate or support member and thus was not exposed to the positive charge. This difference in exposure potential inhibits the ability to uniformly negatively charge the photoreceptor. The portion of the photoreceptor that is exposed to the positive over-spray cannot retain the negative charge as well as the portions of the photoreceptor that were not exposed to the positive over-spray.

The more positive charge that is involved in transfer, the more exaggerated the above-mentioned problems tend to be. For example, both heavy weight paper and humidity conditions require more positive charge for efficient image transfer, and thus result in significant photoreceptor charge non-uniformity and a significant decrease in photoreceptor charge retention. Xerographic process control can be made difficult and the customer could detect the effects (e.g., undesirable print marks) when changing paper size or pitch mode. These problems occur regardless of the type of image. For example, these problems occur in both halftone and full color image copying/printing.

The present inventors have discovered that after transfer and after the substrate or support member has been separated from the photoreceptor, but before charging of the photoreceptor for the next cycle in the xerographic process, exposure of the photoreceptor to fluorescent light at least attenuates the problems associated with positive over-spray. The fluorescent light exposure can bring a positive-charge-induced non-uniformity signal down to a non-printable level.

These and other features and advantages of the invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

In the following detailed descriptions, the term "positive over-spray" refers to exposure of any portion of the photoreceptor surface to positive ions. For example, during image transfer, when the substrate or support member is placed in contact with the photoreceptor and sprayed with positive ions, there is at least a portion of the photoreceptor's surface that is not covered by the substrate or support member and is exposed to positive ions. This is referred to as positive over-spray.

Figure 1:
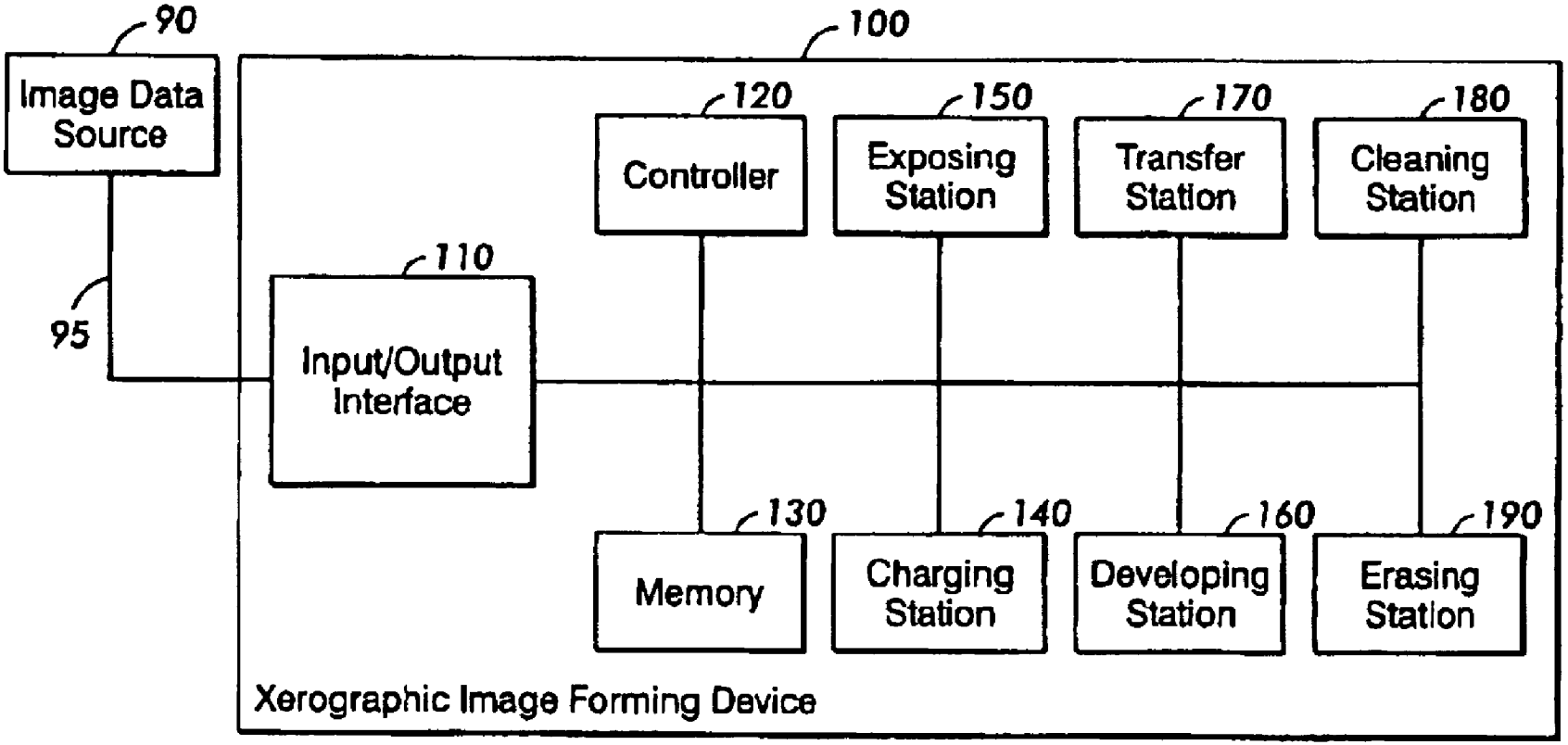
FIG. 1 (PRIOR ART)
FIG. 1 is a block diagram outlining the elements of a known xerographic image-forming device.

FIG. 1 is a block diagram outlining the elements of a known xerographic image-forming device 100. The xerographic image forming device 100 is connected to an image data source 90 over a signal line or link 95. The image data source 90 provides image input data to the xerographic image forming device 100.

In general, the image data source 90 can be any one or more of a number of different sources, such as a scanner, a digital copier, a facsimile device that is suitable for generating electronic image data, or a device suitable for storing and/or transmitting electronic image data, such as a client or server of a network, such as the Internet, and especially the World Wide Web, for example. Thus, the image data source 90 can be any known or later-developed source that is capable of providing image data to the xerographic image forming device 100. The signal line or link 95 can be implemented using a public switched telephone network, a local or wide area network, an intranet, the Internet, a wireless transmission channel, or any other known or later-developed distributed network, of the like.

When the image data source 90 is a personal computer, the link 95 connecting the image data source 90 to the xerographic image forming device 100 can be a direct link between the personal computer and the xerographic image forming device 100. The link 95 can also be a local area network, a wide area network, the Internet, an intranet, or any other distributed processing and storage network. Moreover, the link 95 can also be a wireless link to the image data source 90. Accordingly, it should be appreciated that the image data source 90 can be connected using any known or later-developed system that is capable of transmitting data from the image data source 90 to the xerographic image forming device 100.

It should be appreciated that, while the electronic image data can be generated at the time of printing an image from the input physical document, the electronic image data could have been generated at any time in the past. Moreover, the electronic image data need not have been generated from the input physical document, but could have been created from scratch electronically. The image data provided by the image data source 90 is received by the input/output interface 110. The image data from the input/output interface 110, under the control of the controller 120, either is forwarded directly to the appropriate station or is initially stored in the memory 130. If the image data is first stored in the memory 130, the controller 120 can subsequently forward the image data from the memory 130 to the appropriate The memory 130 can be implemented using any appropriate combination of alterable, volatile or non-volatile, memory; or non-alterable or fixed memory. The alterable memory, whether volatile or non-volatile, can be implemented using any one or more of static or dynamic RAM, a floppy disc and disc drive, a writeable or rewriteable optical disc and disc drive, a hard drive, flash memory or the like. Similarly, the non-alterable or fixed memory can be implemented using any one or more of ROM, PROM, EPROM, EEPROM, an optical ROM disc, such as CD ROM or DVD ROM disc, and disc drives or the like.

Further, although the description in FIG. 1 is with reference to a printing/copying machine that utilizes a signal line or link 95, it will be readily apparent to one of ordinary skill in the art that the principles of the present invention can be directly applied to a conventional electrophotographic imaging apparatus, such as a photo-copier. In such a device, the image data is directly transferred to the photoreceptor surface as a light image of the document. The present invention is thus equally applicable to imaging apparatuses, such as photo-copiers, as well as to non-imaging apparatuses such as laser printers and the like.

The charging station 140 uniformly negatively charges the surface of a photoreceptor. The exposing station 150 exposes the negatively charged photoreceptor surface to a light pattern of the input image, selectively discharging the surface in accordance with the image, thereby forming a latent image. The latent image is developed by developing station 160 by contacting the latent image with toner. The toner image is transferred to a substrate or support member at the transfer station 170, and the image is then affixed to the substrate or support member by a fusing process to form a permanent image. After transfer, excess toner left on the photoreceptor is cleaned from its surface at the cleaning station 180 and residual charge is erased from the photoreceptor at the erasing station 190. This process can then be repeated using the same xerographic image forming device 100 for subsequent input images.

Figure 2:
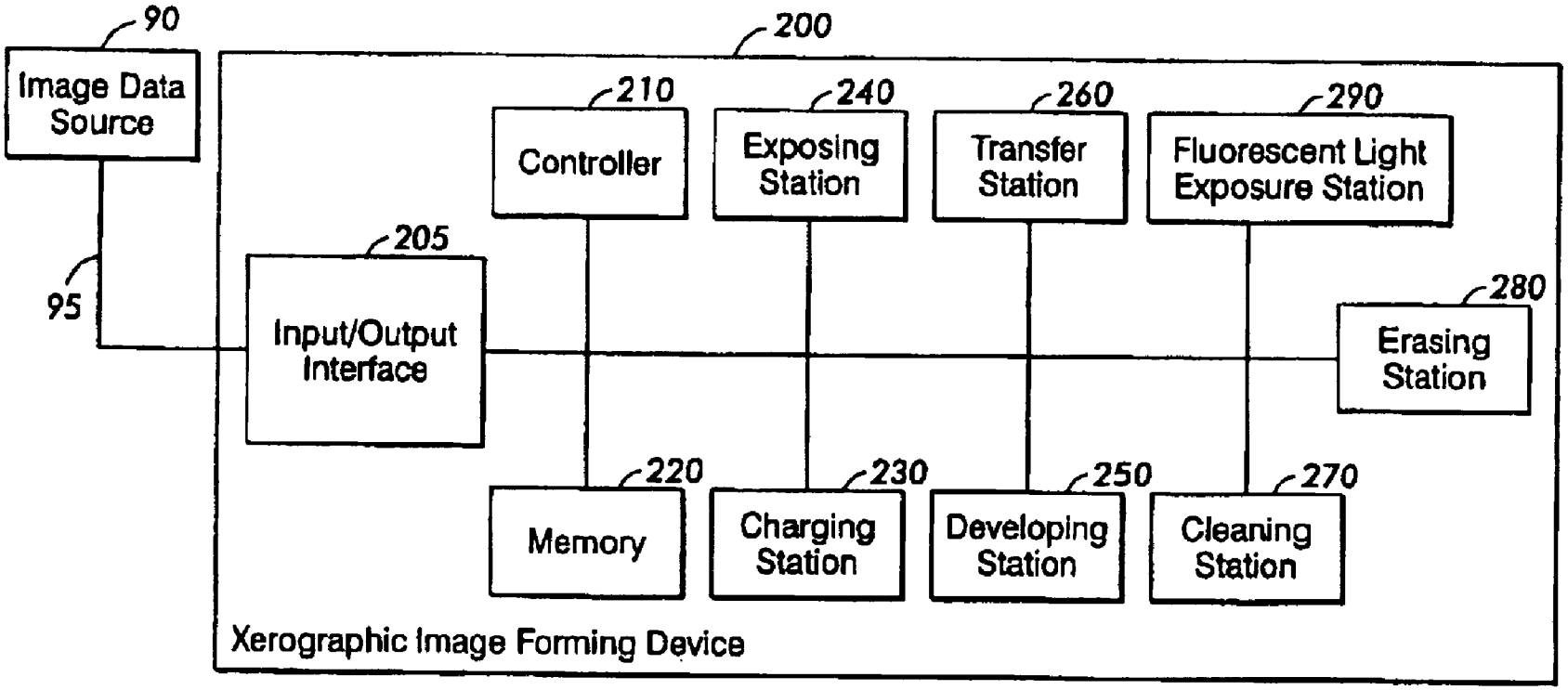
FIG. 2 is a block diagram outlining one exemplary embodiment of the image-forming device of FIG. 1, with the addition of a fluorescent light exposure station according to the present invention.

FIG. 2 is a block diagram outlining the elements of one exemplary embodiment 200 of the xerographic image forming device 100 of FIG. 1. In this exemplary embodiment, a fluorescent light exposure station 290 has been added. In one exemplary embodiment, the fluorescent light exposure station 290 may be positioned between the transfer station 260 and the cleaning station 270. In another exemplary embodiment, the fluorescent light exposure station 290 may be positioned after the cleaning station 270. In other exemplary embodiments, the fluorescent light exposure station may be located at various places within the xerographic image forming device 200.

In various exemplary embodiments, fluorescent light can be provided by a lamp, multiple lamps, a bulb, and/or multiple bulbs. In addition, any other appropriate structure can be used in order to provide the fluorescent light. The structure that is used may be a permanent addition to the image-forming device, or may be a temporary addition. In various other exemplary embodiments, the image-forming device need not perform a xerographic process per se, as long as the problem of positive over-spray, or an equivalent problem, occurs before, during or after the image forming process performed by the image forming device.

Figure 3:
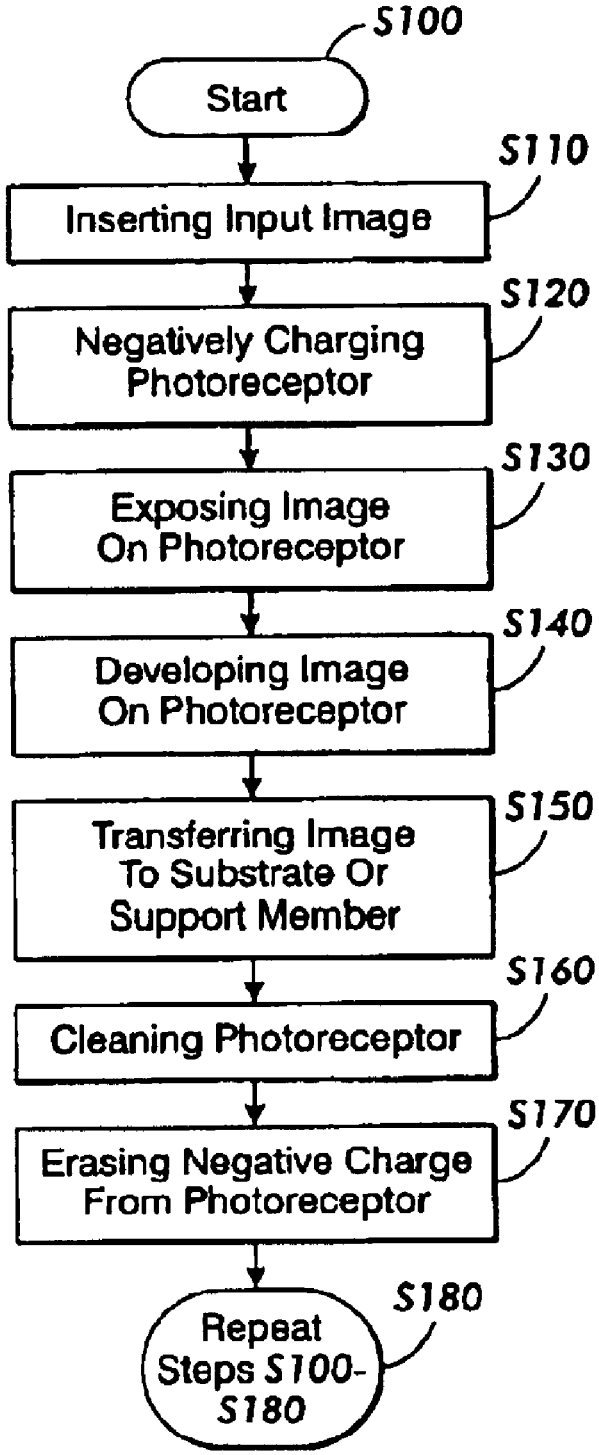
FIG. 3 (PRIOR ART)
FIG. 3 is a flowchart outlining one exemplary embodiment of a known xerographic process.

FIG. 3 is a flowchart outlining a method for forming an image using a xerographic image forming device. Beginning in step S100, the operation proceeds to step S110, where initial image data is input. Then, in step S120, the photoreceptor is negatively charged. Next, in step S130, the photoreceptor is exposed to a light pattern of the input image, thereby forming a latent image on the photoreceptor. Operation then continues to step S140.

In step S140, the latent image is developed on the photoreceptor. Then, in step S150, the developed image is transferred to a substrate or support member. Next, in step S160, the photoreceptor surface is cleaned. Then, in step S170, the negative charge on the photoreceptor is erased. Operation of the method continues to step S180, where operation of the method may begin again at step S100, or alternatively, stop.

Figure 4:
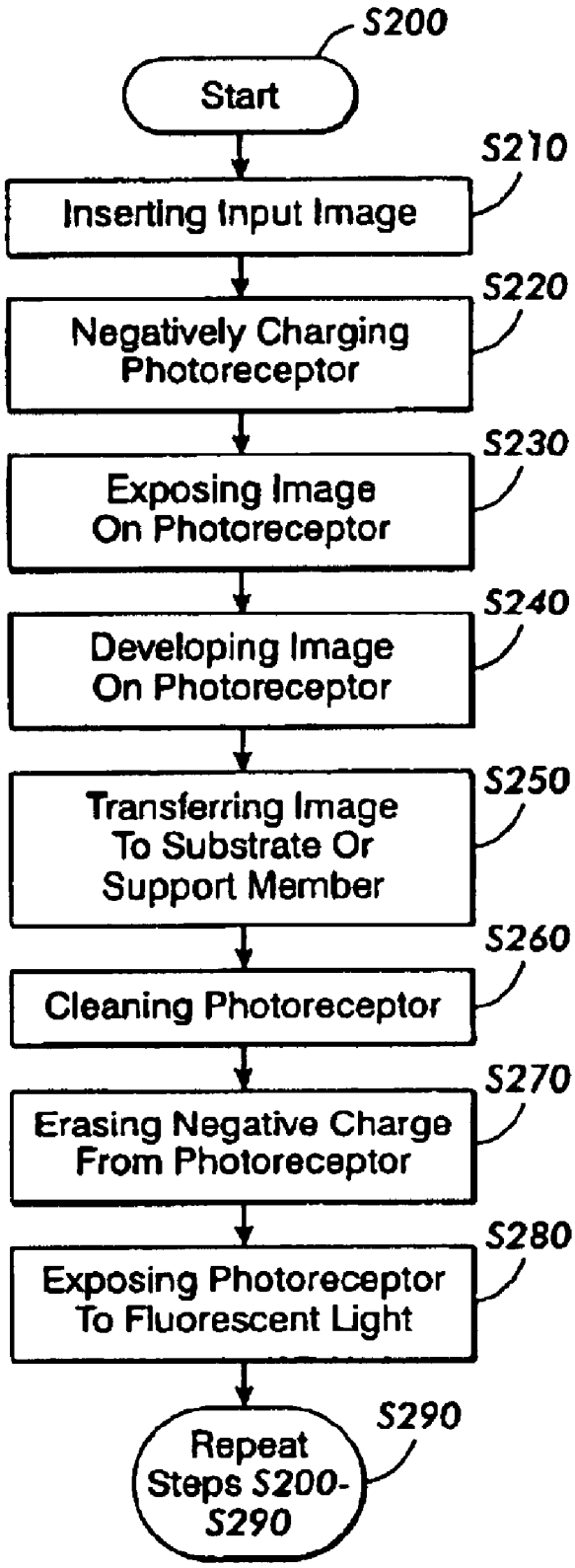
FIG. 4 is a flowchart outlining one exemplary embodiment of the xerographic process of FIG. 3, with the addition of the step of exposing the photoreceptor to fluorescent light after the cleaning step according to an embodiment of the present invention.

FIG. 4 is a flowchart outlining one exemplary embodiment of the method of FIG. 3, in which after the step of cleaning the photoreceptor, a new step S280 of exposing the photoreceptor to fluorescent light is added. Step S280 occurs after step 5260 of cleaning the photoreceptor, either before or after erasing step S270.

Figure 5:
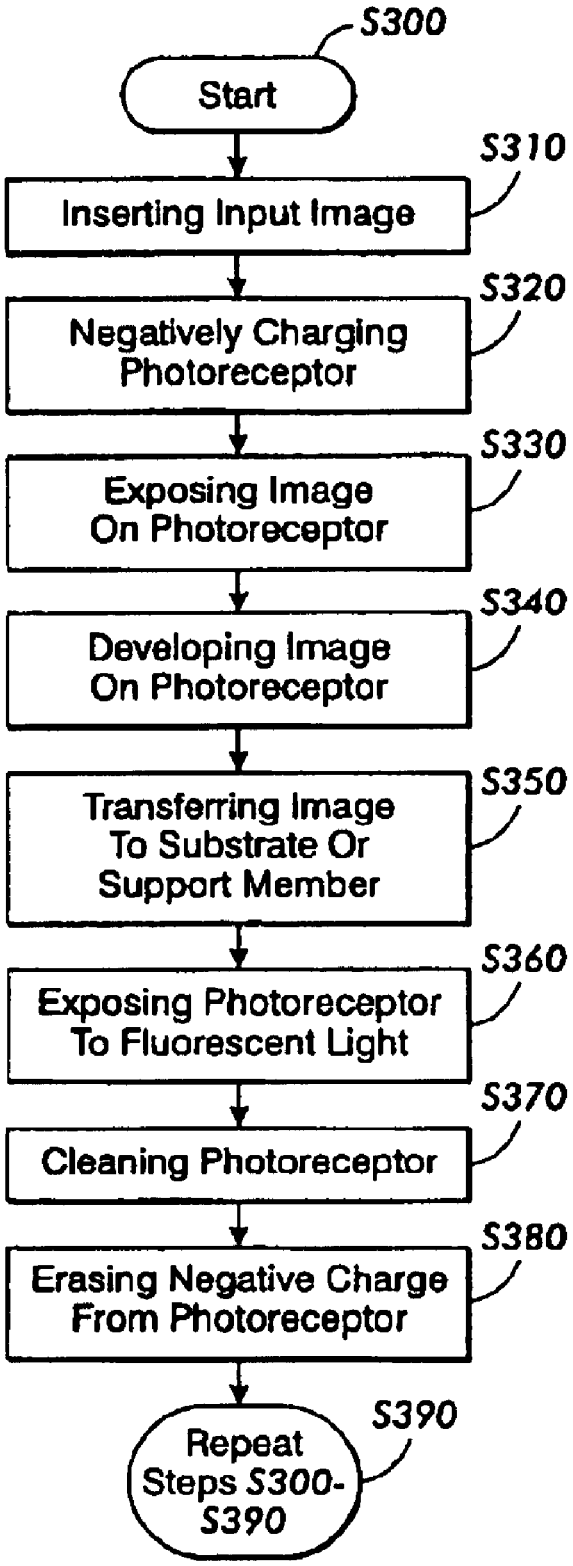
FIG. 5 is a flowchart outlining one exemplary embodiment of the xerographic process of FIG. 3, with the addition of the step of exposing the photoreceptor to fluorescent light after the transfer step but before the cleaning step according to an embodiment of the present invention.

FIG. 5 is a flowchart outlining one exemplary embodiment of the method of FIG. 3, in which step S360 of exposing the photoreceptor to fluorescent light is added between the transfer step S350 and the cleaning photoreceptor step S370.

In various exemplary embodiments, the photoreceptor can be exposed to fluorescent light after the transfer step, but before the charging step of a subsequent cycle in xerographic process, in which the photoreceptor is charged a single time, exposed to the input image a single time, and the latent image is developed a single time.

In various other exemplary embodiments, the photoreceptor can be exposed to fluorescent light after the transfer step, but before the charging step of the next cycle of a xerographic process, in which the photoreceptor is charged multiple times, and/or the photoreceptor is exposed to an input image multiple times, and/or the latent image is developed multiple times.

In various exemplary embodiments, the photoreceptor can be exposed to fluorescent light after the transfer step, but before the cleaning step of a xerographic process. In various other exemplary embodiments, the photoreceptor can be exposed to fluorescent light after the cleaning step, but before the charging step of a subsequent cycle of xerographic process. In various other exemplary embodiments, the photoreceptor can be exposed to fluorescent light at any point along the xerographic process. In various other exemplary embodiments, the photoreceptor can be exposed to fluorescent light multiple times and/or by multiple sources during the xerographic process.

In various exemplary embodiments of the present invention, exposure of the photoreceptor to fluorescent light can be used to address and reduce the occurrence of various print defects in the resultant images. For example, in embodiments, the various effects of positive over-spray can be at least attenuated, and in some cases eliminated, by exposure of the photoreceptor to fluorescent light. In turn, because the effects of positive over-spray are at least reduced, related issues in the development apparatus can also be addressed. In particular, the inability to uniformly charge the photoreceptor and the inability of portions of a photoreceptor that have been exposed to positive ions to retain negative charge are at least attenuated by exposing the photoreceptor to fluorescent light.

As discussed above, the signal induced by regional positive over-spray is seen as the photoreceptor voltage non-uniformity that creates undesirable print marks and makes process control difficult. Fluorescent light exposure can bring a pre-existing positive-charge-induced non-uniformity signal down to a non-printable level. Fluorescent light can be applied in any application where an organic photoreceptor is affected by positive charges applied at transfer or at any other point in a xerographic or similar process.

Applicants have discovered that exposing the photoreceptor to fluorescent light reduces an exposure potential differential on the photoreceptor's surface in less time than a reduction would occur on the surface of a photoreceptor that has not been exposed to fluorescent light, and in less time than negative charge-erase cycling or print cycling would reduce an exposure potential differential on the surface of the photoreceptor. Therefore, fluorescent light treatment can extend the life of the photoreceptor and improve system reliability by reducing the effects of unwanted positive charge on the photoreceptor outside the paper area. Further, it can reduce unscheduled maintenance and premature photoreceptor replacement, and can be used in place of negative charge-erase cycling or print cycling.

Light shock is a problem recognized for certain kinds of photoreceptors in xerography, but is not caused by the xerographic process itself. Light shock is caused by exposure of the photoreceptor to ambient light, such as the ceiling light present in a room in which the xerographic image forming device resides. Sensitivity to positive over-spray and sensitivity to light shock are not mutually exclusive and are not related, although exposing the photoreceptor surface to fluorescent light can also at least attenuate some negative effects of light shock.

Although the present inventors have discovered that fluorescent light can contribute to the mitigation of the negative affects of positive over-spray on a photoreceptor, the present inventors have also discovered that the amount of mitigation and the rate of mitigation vary. Factors that affect the amount and rate of mitigation include, but are not limited to, the intensity of the fluorescent light, the quantity of sources providing the fluorescent light, the length of exposure of the photoreceptor to the fluorescent light and the frequency of exposure of the photoreceptor to the fluorescent light. For example, the present inventors have discovered that the length of exposure can be decreased without decreasing the amount and/or rate of mitigation by increasing the intensity of the fluorescent light, increasing the quantity of sources providing the fluorescent light, and/or increasing the frequency of exposure of the photoreceptor to the fluorescent light.

In various exemplary embodiments, the photoreceptor is exposed to fluorescent light for a period less than about one second, less than about 1 minute, or less than about five minutes. In various other exemplary embodiments, the photoreceptor is exposed to fluorescent light for a period greater than about five minutes, greater than about 30 minutes, or greater than about 60 minutes. In various other exemplary embodiments, the photoreceptor is exposed to fluorescent light for a period ranging from about 5 to about 60 minutes, from about 15 to about 50 minutes, and from about 25 to about 40 minutes.

For example, and as will be apparent based on the present disclosure, the fluorescent light exposure time can be varied depending on how the fluorescent light exposure is incorporated into the xerographic process. Thus, for example, where the fluorescent light exposure step is conducted repeatedly, such as at random intervals, once every imaging cycle, or once every $n^{th}$ imaging cycle (where n can be, for example, an integer of from 2 to 1000 or more or any number in between, such as 2, 5, 10, 50, 100, 200, 500 or 1000), the fluorescent light exposure time can be very short to prevent undesired prolongation of the imaging cycle and resultant loss of throughput. In these instances, the exposure time can be as small as a fraction of a second, such as from about 10 milliseconds or less to about 500 milliseconds or more.

In other embodiments, the fluorescent light exposure operation of the present invention can be performed on a more periodic interval and as a maintenance operation. In these embodiments, the fluorescent light exposure step can be performed on an as-needed basis, such as either during routine maintenance of the imaging apparatus, on a periodic basis such as during self-maintenance by the imaging apparatus itself, or on a random basis. Thus, for example, during routine maintenance, a technician can perform the fluorescent light exposure step to attenuate the positive over-spray effects. Similarly, the fluorescent light exposure step can be performed during routine self-maintenance of the imaging apparatus, such as during a preset daily or multiple-daily self-test and self-maintenance. In these embodiments, the fluorescent light exposure step can be performed for a much longer period of time as compared to the above-described frequent exposure operation, as needed to achieve the desired results. Such exposure could be, for example, for a time of as short as about one minute or less or about five minutes or less, up to as long as about fifteen minutes or more or about 30 minutes or more.

In still other embodiments, the fluorescent light exposure step can be automatically performed by the imaging apparatus on an as-needed basis, based on detection of a threshold positive over-spray effect by a controller within the imaging apparatus. Such automatic detection can be implemented, for example, by either a visible image sensor or a voltage sensor, to detect the presence and magnitude of positive over-spray effect. In these embodiments, the fluorescent light exposure step could thereafter be performed either for a set period of time, which could be repeated as needed, or could be performed for a period of time until the positive over-spray effect is determined to be attenuated to below a threshold value.

In various exemplary embodiments, fluorescent light bulb or bulbs used for the invention may range from about 5 Watt (or less) fluorescent light bulbs to about 55 Watt (or more) fluorescent light bulbs, such as from about 10 to about 40 Watt fluorescent light bulbs, from about 5 to about 20 Watt fluorescent light bulbs, and from about 25 to about 42 Watt fluorescent light bulbs. Suitable fluorescent light bulbs include, but are not limited to, 5 Watt, 8 Watt, 9 Watt, 10 Watt, 11 Watt, 12 Watt, 13 Watt, 14 Watt, 15 Watt, 16 Watt, 17 Watt, 18 Watt, 20 Watt, 21 Watt, 23 Watt, 25 Watt, 28 Watt, 32 Watt, 38 Watt, 40Watt, 42 Watt, 50 Watt and 55 Watt fluorescent light bulbs. In various other exemplary embodiments, the fluorescent light bulb or bulbs used for the invention may range from about 250 lumen (or less) fluorescent light bulbs to about 4000 lumen (or more) fluorescent light bulbs, such as from about 250 lumen fluorescent light bulbs to about 825 lumen fluorescent light bulbs, from about 900 to about 3200 lumen fluorescent light bulbs, and from 3200 to 4000 lumen fluorescent light bulbs. Suitable fluorescent light bulbs include, but are not limited to, 250 lumen, 550 lumen, 650 lumen, 765 lumen, 825 lumen, 900 lumen, 1100 lumen, 1200 lumen, 1710 lumen, 1750 lumen, 3200 lumen, and 4000 lumen fluorescent light bulbs.

In various exemplary embodiments, the fluorescent light can be provided by at least one fluorescent light bulb. In various other exemplary embodiments, the fluorescent light is provided by two or more fluorescent light bulbs. When multiple fluorescent bulbs are used, they may be the same or different types of fluorescent light bulbs, or a combination thereof. In various exemplary embodiments, the fluorescent light bulb or bulbs may be in at least one of the following shapes: reflector, globe, twist, standard, household, cylinder and chandelier. In various other exemplary embodiments, the fluorescent light bulb or bulbs may have a single pin or multiple pins, such as bi-pin or 4-pin bulbs. In various other exemplary embodiments, the fluorescent light bulb or bulbs may be compact. In various other exemplary embodiments, the fluorescent light bulb or bulbs may be preheat bulbs and/or rapid start bulbs. In various other exemplary embodiments, the fluorescent light bulb or bulbs used for the invention may be warm white, neutral white, soft white, cool white, very cool white, natural white, soft tone, very warm tone and frosted. In various other exemplary embodiments, the fluorescent light bulb or bulbs may be single or multi-tube bulbs, and/or single or multi-band bulbs.

An example is set forth hereinbelow and is illustrative of embodiments of the present invention. It will be apparent, however, that the invention can be practiced with many types of compositions and can have many different uses in accordance with the disclosure above and as pointed out hereinafter.

EXAMPLE

Through experimentation, the results of which are illustrated in FIGS. and 7, Applicants have discovered that transfer corotron positive over-spray has a negative impact on the performance of multilayered organic photoreceptors. Specific examples of the negative impact include localized high dark decay and voltage non-uniformity. Applicants have found that positive ions from the transfer station produce a change in exposure potential on the photoreceptors, and that this effect saturates at about 10,000 prints. The potential change across the surface of the photoreceptor was found to be at least as large as about 15 volts for heavy weight paper in a low humidity environment. This effect is illustrated in FIG. 6.

Figure 6:
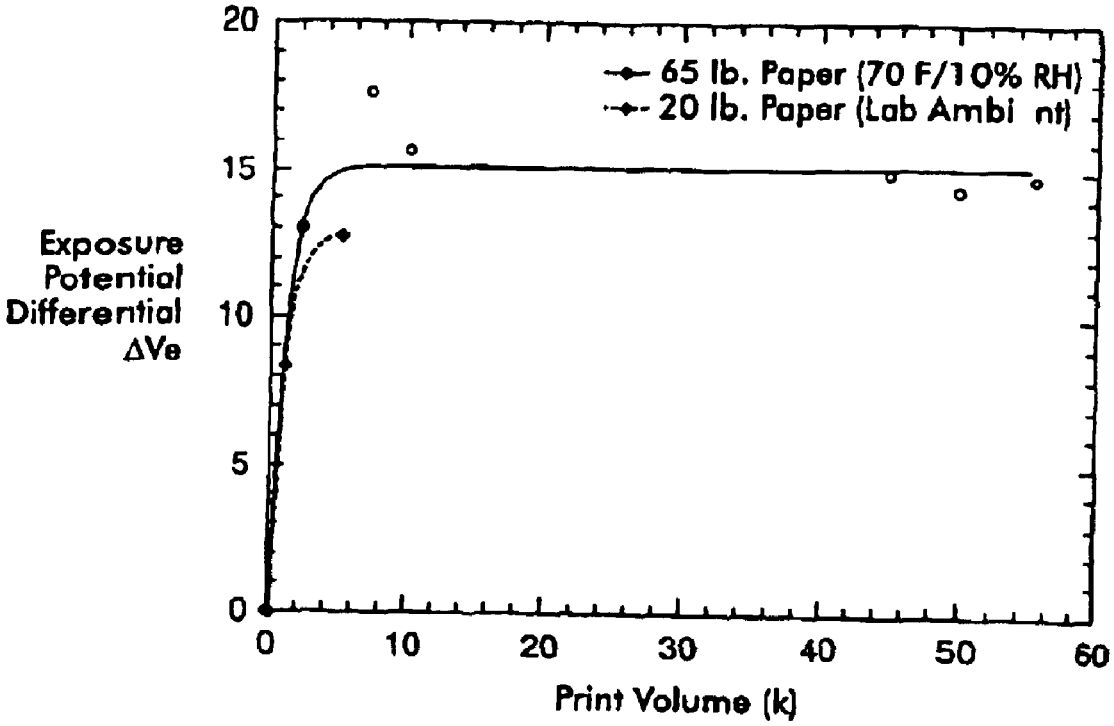
FIG. 6 is a graph illustrating the effects of positive over-spray on the exposure potential differential across a photoreceptor surface under normal and stress conditions.

FIG. 6, illustrates the negative effect that positive over-spray has on the exposure potential differential across the surface of an organic photoreceptor. The hollow circles demonstrate that a change in the exposure potential differential across the surface of a photoreceptor when heavy paper is used in a low humidity environment (i.e., "stress" conditions) can be detected after less than 1000 prints. In this example, the potential across the surface of the photoreceptor can vary up to 15V, after which the effect of the positive over-spray seems to be saturated. This non-uniform exposure potential across the surface of the photoreceptor, in this case up to a 15V difference, results in poor print quality, and a decrease in the maximum life of the photoreceptor.

The solid circles demonstrate that the negative effects of positive over-spray on exposure potential across the surface of an organic photoreceptor can also be seen using normal paper at normal, ambient room temperature (i.e., "non-stress" conditions). The negative effects under non-stress conditions are comparable to the negative effects seen under stress conditions. Similarly, Applicants have found that the negative effects of positive over-spray are comparable in the generation of different types of images, such as full color and halftone images, among others.

In this example, cycling under intense 3-band natural white fluorescent lamps significantly reduces the negative effects of positive over-spray. The potential difference was reduced from as much as 15 volts without the treatment to less than 3 volts to undetectable with the treatment, as illustrated in FIG. The use of 3-band natural white fluorescent lamps to condition the photoreceptor that has been exposed to positive over-spray in non-paper areas has been found to at least attenuate the negative effects of positive over-spray.

Figure 7:
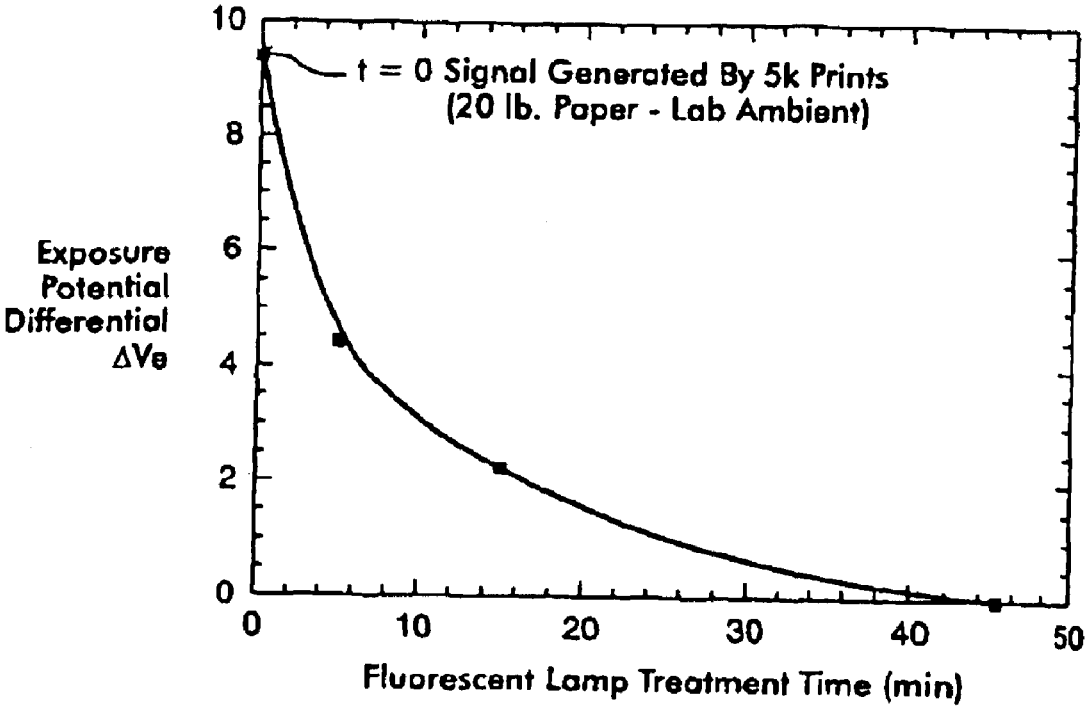
FIG. 7 is a graph illustrating the attenuating effects of fluorescent light on the exposure potential differential across a photoreceptor surface that is affected by positive over-spray.

Although it was found that the effects of positive over-spray relaxes very slowly with rest time or negative charge-erase cycles or print cycles, a pre-existing positive-charge-induced non-uniformity signal of about 10 volts can be brought down to a lower level quickly by fluorescent light exposure. A pre-existing exposure potential differential of about 10 volts was reduced to non-printable level of about 2 in about 15 minutes, as illustrated in FIG. 7.

While this invention has been described in conjunction with the exemplary embodiments outlined above, it is evident that many alternatives, modifications and variations will be apparent to those skilled in the art.

What is claimed is:

1. A method for forming an image, comprising:

charging a photoreceptor at least once;

exposing the charged photoreceptor to an input image to form a latent image;

developing the latent image on the photoreceptor at least once;

transferring the image from the photoreceptor to a support;

exposing areas of the photoreceptor subject to positive over-spray to fluorescent light at least once;

cleaning the photoreceptor at least once; and erasing the photoreceptor at least once.

2. The method according to claim 1, wherein the photoreceptor is subject to positive charges applied during image transfer.

3. The method according to claim 1, wherein the photoreceptor is subject to pre-existing positive charges.

4. The method according to claim 1, wherein the fluorescent light is generated by at least one fluorescent light bulb.

5. The method according to claim 1, wherein the fluorescent light is generated by multiple fluorescent light bulbs.

6. The method according to claim 5, wherein the multiple fluorescent light bulbs are the same.

7. The method according to claim 5, wherein some of the multiple fluorescent light bulbs are different from others of the multiple fluorescent light bulbs.

8. The method according to claim 1, wherein a positive over-spray attenuation means provides the fluorescent light.

9. The method according to claim 1, wherein the step of exposing the photoreceptor to fluorescent light occurs after the step of transferring the image from the photoreceptor to a support.

10. The method according to claim 1, wherein the step of exposing the photoreceptor to fluorescent light occurs after the step of cleaning the photoreceptor.

11. The method according to claim 1, wherein the step of exposing the photoreceptor to fluorescent light at least attenuates the effects of positive over-spray.

12. The method according to claim 1, wherein the step of exposing the photoreceptor to fluorescent light at least attenuates potential non-uniformity on a surface of the photoreceptor resulting from positive over-spray.

13. The method according to claim 1, wherein the step of exposing the photoreceptor to fluorescent light at least attenuates localized high dark decay resulting from positive over-spray.

14. The method according to claim 1, wherein positive over-spray results in a potential differential on a surface of the photoreceptor of about 15V or more before said step of exposing the photoreceptor to fluorescent light.

15. The method according to claim 1, wherein the step of exposing the photoreceptor to fluorescent light decreases a potential differential on a surface of the photoreceptor by about 15V.

16. The method according to claim 1, wherein the step of exposing the photoreceptor to fluorescent light decreases a potential differential on a surface of the photoreceptor to less than about 3V.

17. The method according to claim 1, wherein the step of exposing the photoreceptor to fluorescent light is performed for less than one second.

18. The method according to claim 1, wherein the step of exposing the photoreceptor to fluorescent light is performed for less than five minutes.

19. The method according to claim 1, wherein the step of exposing the photoreceptor to fluorescent light is performed for greater than five minutes.

20. The method according to claim 1, wherein the step of exposing the photoreceptor to fluorescent light is performed for greater than 30 minutes.

21. The method according to claim 1, wherein the step of exposing the photoreceptor to fluorescent light is performed during or after every cycle of a xerographic process.

22. The method according to claim 1, wherein the step of exposing the photoreceptor to fluorescent light is performed periodically.

23. The method according to claim 1, wherein the step of exposing the photoreceptor to fluorescent light is performed at random intervals.

24. An image forming device, comprising:

a photoreceptor, at least one charging station, an exposing station, at least one developing station, a transfer station, at least one fluorescent light exposing station that exposes areas of the photoreceptor that are subject to positive over-spray to fluorescent light, a cleaning station and an erase station.

25. The image forming device of claim 24, wherein the photoreceptor is an organic photoreceptor.

26. The image forming device of claim 24, wherein the at least one fluorescent light generating station comprises at least one fluorescent light bulb.

27. The image forming device of claim 24, wherein the at least one fluorescent light generating station comprises multiple fluorescent light bulbs.

28. The image forming device of claim 27, wherein the multiple fluorescent light bulbs are the same.

29. The image forming device of claim 27, wherein some of the multiple fluorescent light bulbs are different from others of the multiple fluorescent light bulbs.

30. The image forming device of claim 24, wherein the at least one fluorescent light exposing station is positioned after the transfer station in an image forming path of the image forming device.

31. The image forming device of claim 24, wherein the at least one fluorescent light exposing station is positioned after the cleaning station in an image forming path of the image forming device.

32. A method of attenuating effects of positive over-spray on a photoreceptor, comprising exposing areas of the photoreceptor that are subject to positive over-spray to fluorescent light.

33. The method according to claim 32, wherein the photoreceptor is an organic photoreceptor.

34. The method according to claim 32, wherein the step of exposing the photoreceptor to fluorescent light at least attenuates potential non-uniformity on the surface of the photoreceptor resulting from positive over-spray.

35. The method according to claim 32, wherein the step of exposing the photoreceptor to fluorescent light at least attenuates localized high dark decay resulting from positive over-spray.

36. The method according to claim 32, wherein the step of exposing the photoreceptor to fluorescent light reduces positive charge density on the photoreceptor.

* * * * *